US009365965B2

(12) United States Patent
West et al.

(10) Patent No.: US 9,365,965 B2
(45) Date of Patent: Jun. 14, 2016

(54) ADJUSTABLE WIDTH STEAM BOX FOR FABRIC PROCESSING AND METHOD OF USING THE SAME

(71) Applicants: Mark Troy West, Charlotte, NC (US); Barry Defoy Miller, Lexington, NC (US)

(72) Inventors: Mark Troy West, Charlotte, NC (US); Barry Defoy Miller, Lexington, NC (US)

(73) Assignee: Tubular Textile Machinery, Inc., Lexington, NC (US)

( * ) Notice: Subject to any disclaimer, the term of this patent is extended or adjusted under 35 U.S.C. 154(b) by 364 days.

(21) Appl. No.: 13/955,880

(22) Filed: Jul. 31, 2013

(65) Prior Publication Data

US 2014/0033560 A1 Feb. 6, 2014

Related U.S. Application Data

(60) Provisional application No. 61/677,656, filed on Jul. 31, 2012.

(51) Int. Cl.

| | |
|---|---|
| ***D06B 3/22*** | (2006.01) |
| ***F26B 21/00*** | (2006.01) |
| ***D06B 3/10*** | (2006.01) |
| ***D06C 7/02*** | (2006.01) |
| ***D06B 5/22*** | (2006.01) |

(52) U.S. Cl.

CPC .. *D06B 3/22* (2013.01); *D06B 3/10* (2013.01); *D06B 5/22* (2013.01); *D06C 7/02* (2013.01); *F26B 21/004* (2013.01); *F26B 21/005* (2013.01)

(58) Field of Classification Search

CPC ..... D06B 3/10; D06B 3/22; D06B 5/22; D06C 7/02; F26B 21/004; F26B 21/005

See application file for complete search history.

(56) References Cited

U.S. PATENT DOCUMENTS

| | | | | |
|---|---|---|---|---|
| 3,868,215 | A | 2/1975 | Frezza | |
| 4,183,151 | A | 1/1980 | Frezza | |
| 4,545,857 | A | 10/1985 | Wells | |
| 5,020,469 | A * | 6/1991 | Boissevain ..... | D21F 7/008 118/117 |
| 2006/0051516 | A1 | 3/2006 | Pietikainen et al. | |

OTHER PUBLICATIONS

International Search Report & Written Opinion of the International Searching Authority Application No. PCT/US2013/052257 Completed: Dec. 17, 2013; Mailing Date: Jan. 3, 2014 8 pages.

* cited by examiner

*Primary Examiner* — Jiping Lu

(74) *Attorney, Agent, or Firm* — St. Onge Steward Johnston & Reens LLC

(57) ABSTRACT

A high efficiency steam box, particularly for the processing of fabrics. The box housing is subdivided into a plurality of steam chambers isolated from each other but communicating with a perforated steam tube which extends throughout the housing. Steam is delivered to the center portions of the steam tube and flows toward the ends. Valve pistons are movably positioned in the opposite end portions of the steam tube to confine the steam. The valve pistons are axially adjustable by a screw shaft extending through the steam tube and can be positioned to isolate outer chambers when processing narrow fabrics to prevent or minimize the discharge of steam from steam discharge slots extending beyond the edges of the fabric. Steam flow control can be integrated with positioning of the valve pistons to provide uniform steam flow per unit length of the discharge slots for optimum efficiency in processing and steam utilization.

9 Claims, 4 Drawing Sheets

ADJUSTABLE WIDTH STEAM BOX FOR FABRIC PROCESSING AND METHOD OF USING THE SAME

FIELD OF THE INVENTION

The invention relates to steam boxes, particularly of the type employed in connection with the processing of knitted and other fabrics, and to the use thereof in the processing of fabrics. The new steam boxes enable an improved and significantly more efficient processing of fabrics of different widths.

BACKGROUND OF THE INVENTION

In the processing of fabrics, particularly but not limited to knitted fabrics, there may be one or more processing stages in which steam is applied to a moving web of fabric, in order to provide moisture and/or heat thereto. Commonly, steam is applied by means of steam boxes which are positioned on the processing line and extend transversely across the fabric closely above and/or below the surface of the fabric web. A typical steam box is in the form of an enclosed housing extending across the processing line and provided with a narrow, slot-like opening for the discharge of steam against the surface of the fabric.

In a typical fabric processing line, provision is made for adjustments of the various processing mechanisms, in order to accommodate different widths of fabric being processed. A typical steam box, however, is of fixed width, with one or more steam discharge slots extending across its full width. When processing fabric webs of less than the maximum designed width for the processing line, the steam discharge slots are exposed to the fabric web over only a portion of their full width, allowing for the escape of steam in the outer portions of the discharge slots without performing any useful function on the fabric. Some attempts have been made heretofore to minimize such steam losses, as for example by providing a series of hinged flaps along the sides of the steam box (U.S. Pat. No. 4,183,151). However, such previous efforts have not been very satisfactory, and there is a need for a better solution.

SUMMARY OF THE INVENTION

The present invention is directed to an improved form of steam box of the general type described above, which incorporates an advantageous and highly effective arrangement for adjustably limiting steam discharge from edge portions of a steam box, such that the steam discharge is efficiently directed at the fabric being processed, regardless of its width. The steam box of the invention is divided internally into a plurality of smaller chambers by means of partition plates spaced apart along the length of the box and supplied with steam by means of a perforated steam tube extending through the box. Steam is supplied to a central portion of the perforated steam tube, and valve pistons are positioned in the steam tube on opposite sides of the central steam supply. The valve pistons are controllably movable inward and outward to confine the flow of steam to predetermined central regions of the steam tube. Steam flow out of the steam tube perforations is thus limited to selected ones of the chambers in a predetermined central area of the steam box and is prevented from entering and flowing out of blocked-off chambers at the ends of the steam box.

DETAILED DESCRIPTION OF THE INVENTION

Figure 1:
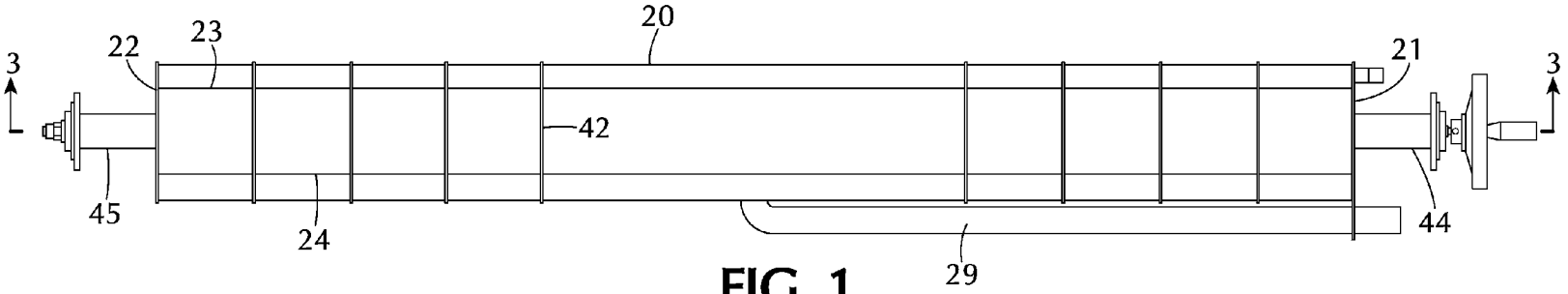
FIG. 1 is a top plan view of an adjustable width steam box according to the invention.
Figure 2:
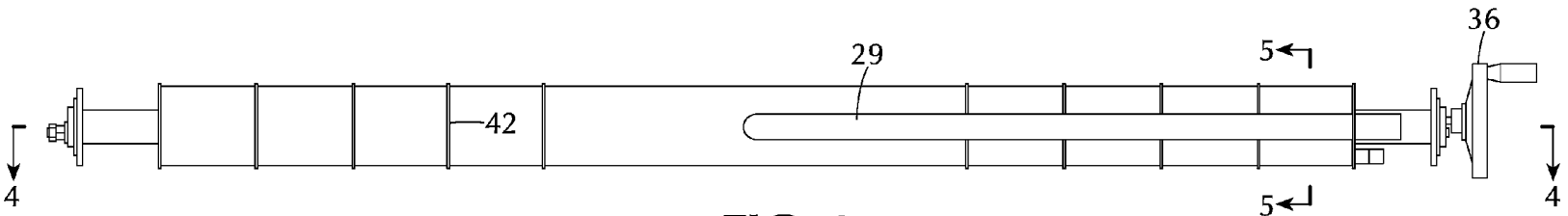
FIG. 2 is side elevational view of the steam box of FIG. 1.
Figure 3:
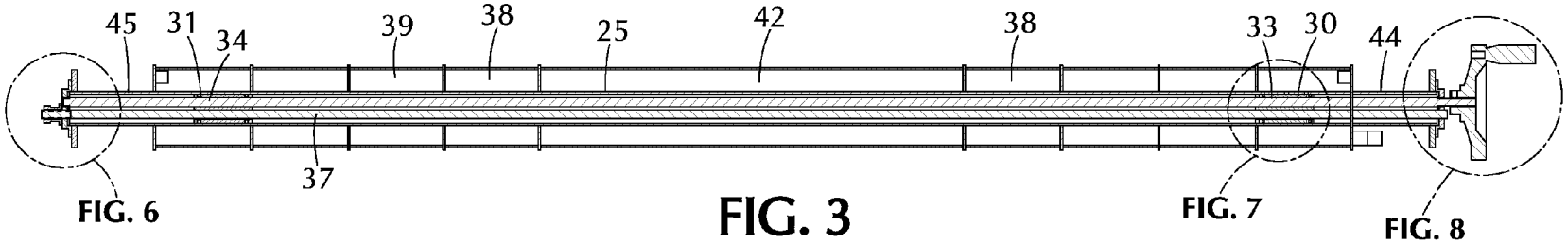
FIG. 3 is a longitudinal cross sectional view as taken on line 3-3 of FIG. 1.

Referring now to the drawings, the reference numeral 20 designates a steam box housing, which is formed of sheet metal and preferably of rectangular cross section. The ends of the housing 20 are closed by end plates 21, 22 such that the housing is sealed except for steam discharge slots 23, 24 which extend over substantially the full length of the housing. A steam tube 25 extends throughout the full length of the housing 20 and for a short distance beyond each end thereof. The steam tube is sealed at the ends and is provided with mounting flanges 26, 27 adjacent its opposite ends by which the steam box is mounted on the machine on which it will be employed. A typical but non-limiting example of such a machine is the Pak Nit II SP Compactor offered by Navis Tube Tex of Lexington, NC, in the operation of which steam is applied to fabric in advance of its being subjected to lengthwise compressive shrinkage.

The steam tube 25 is provided, over the portion thereof within the housing 20, with a plurality of spaced apart orifices 28, for example $\frac{1}{8}^{th}$ inch orifices spaced about one inch apart, for the discharge of steam under pressure from the inside of the tube into the interior of the housing 20. The steam thus discharged diffuses within the housing and exits through the longitudinal steam discharge slots 23, 24

Figure 4:
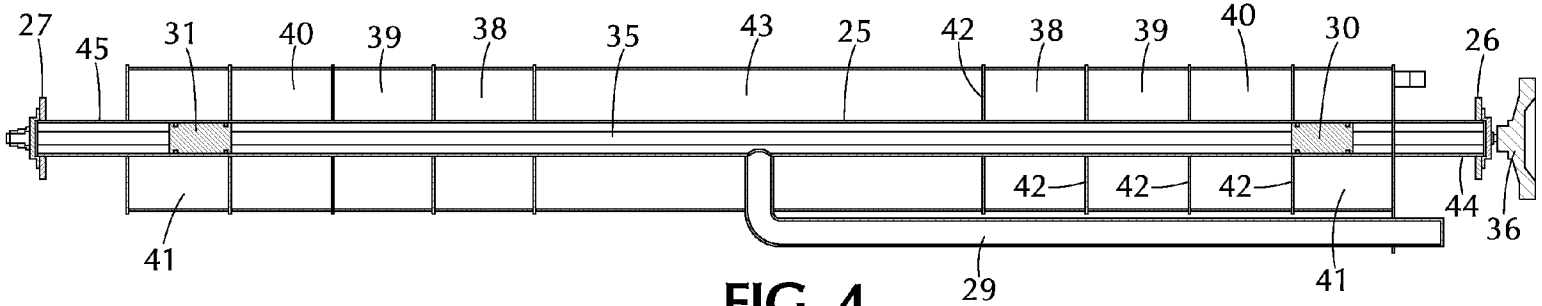
FIG. 4 is a longitudinal cross sectional view as taken on line 4-4 of FIG. 2.
Figure 5:
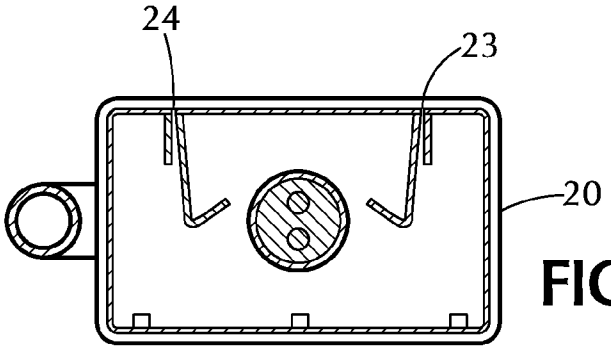
FIG. 5 is a transverse cross sectional view as taken on line 5-5 of FIG. 2.
Figure 8:
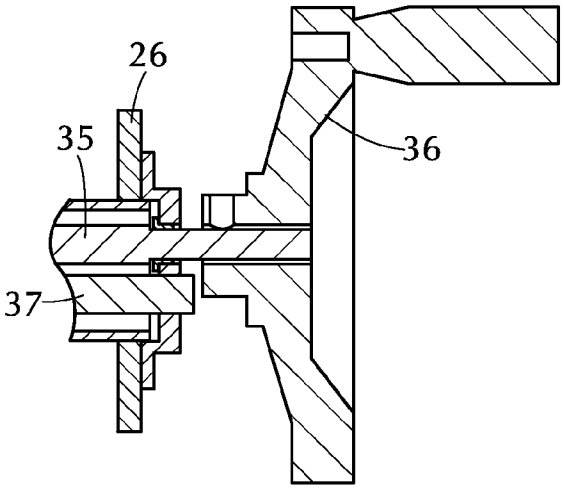
FIG. 8 is an enlarged view of the circled Detail "FIG. 8" at the right end of FIG. 3.
Figure 7:
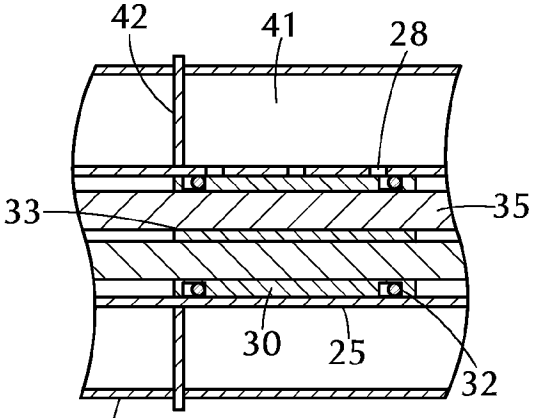
FIG. 7 is an enlarged view of the circled Detail "FIG. 7" at the right side of FIG. 3.
Figure 6:
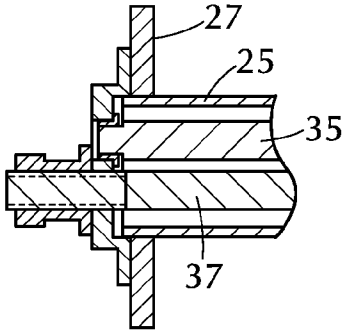
FIG. 6 is an enlarged view of the circled Detail "FIG. 6" at the left end of FIG. 3.

In accordance with one aspect of the invention, steam is introduced into the steam tube 25 through a steam inlet pipe 29, which communicates with a central point along the steam tube, as shown in FIG. 4. Steam entering the steam tube thus flows in opposite directions, toward each end of the tube. In addition, valve pistons 30, 31 are positioned in opposite end portions of the steam tube and serve to seal the steam tube internally and confine the incoming steam to that portion of the steam tube 25 which lies between the valve pistons. In the illustrated form of the invention, the valve pistons 30, 31 are in the form of somewhat elongate, cylindrical piston bodies (i.e., of greater length than diameter), provided adjacent each end with an O-ring sealing element 32.

In accordance with yet another aspect of the invention, the valve pistons 30, 31 are provided with internally threaded bores 33, 34 which receive a threaded shaft 35. The shaft 35 extends throughout the length of the steam tube 25 and, in the illustrated embodiment of the invention, is fixed at one end to a hand wheel 36 or similar element to enable operator rotation of the shaft. The shaft 35 may also be driven by a motor (not shown) to provide for remote and/or automatic control of shaft rotation. The shaft 35 is oppositely threaded at opposite ends, and the respective valve pistons 30, 31 are likewise oppositely threaded for engagement with the shaft 35. Accordingly, rotation of the shaft 35, will cause the valve pistons 30, 31 to move toward or away from each other to reduce or enlarge the length of the steam tube that contains steam.

In some cases, particularly with relatively large steam tubes 25 where it may be advantageous to locate the threaded shaft 35 at or close to the center of the steam tube, a guide rod 37 may be extended through the steam tube 25 and through bearing passages in the valve pistons 30, 31, to prevent rotation of the valve pistons within the steam tube. In the specific arrangement illustrated herein, the threaded shaft 35 is shown to be well off of center, in which case the function of the guide rod is less important.

In accordance with yet another aspect of the invention, at least the end portions of the steam box housing 20 are divided into a plurality of smaller internal chambers 38-41, by means of internal divider or partition plates 42. In the illustrated form of the invention, four relatively small chambers 38-41 are provided in each of the opposite ends of the steamer housing 20, it being understood that neither the number nor the size of the chambers 38 is considered to be critical, as long as there is a sufficient number of chambers to accommodate the variety of fabric widths expected to be processed by the steam box. A larger center chamber 43 can be of a width corresponding to the narrowest width fabric expected to be processed by the steam box, and is typically much larger than the chambers 38-41 at the ends of the housing 20.

Figure 9:
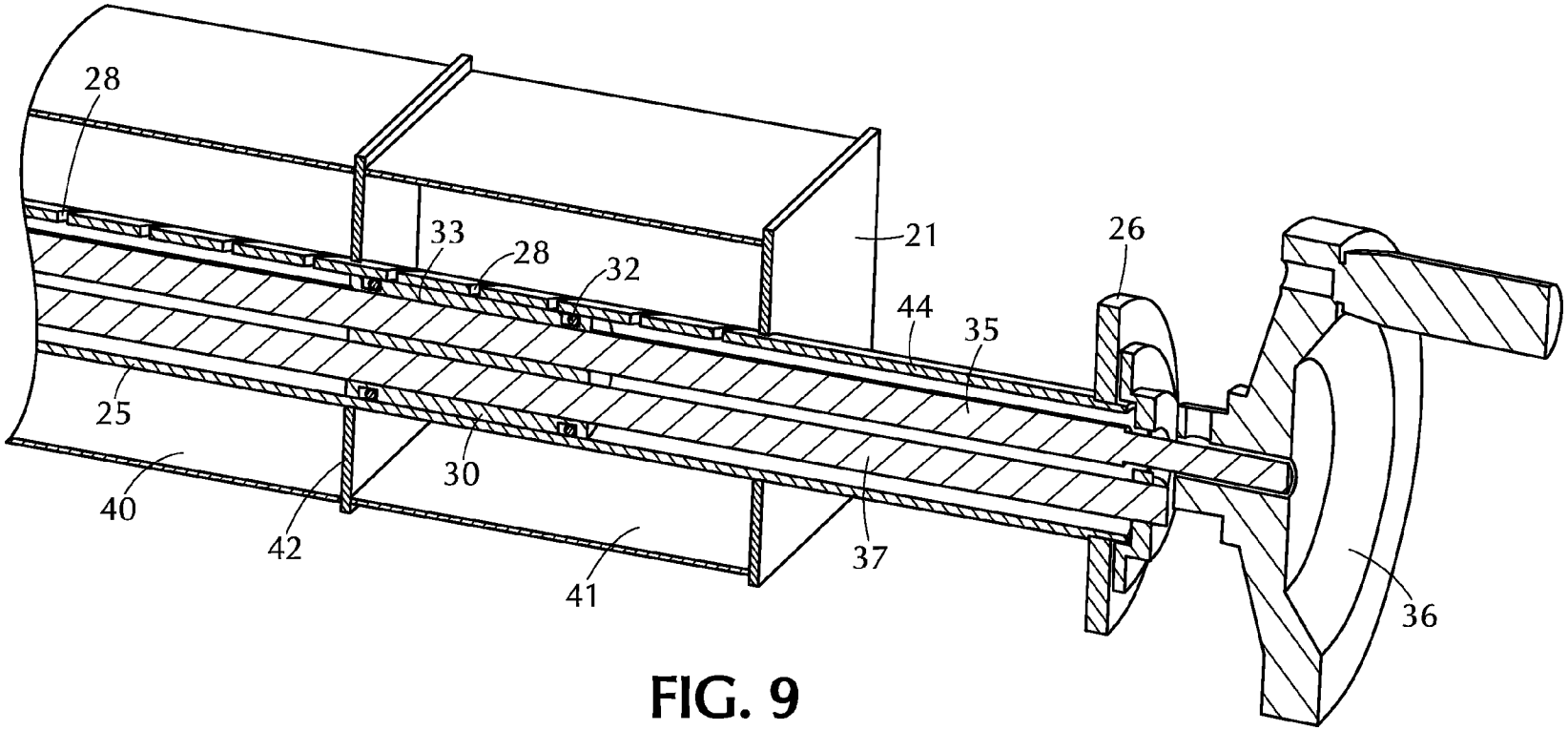
FIG. 9 is an enlarged cross sectional view, shown in perspective of an end portion of the new steam box.

According to the invention, each of the small chambers 38-41 is isolated from the other small chambers, and the innermost small chambers 38 are isolated from the larger center chamber 43, except that all of the chambers 38-41 and 43 can communicate with and receive steam from the steam tube 25. When the valve pistons 30, 31 are retracted to positions completely or mostly within the extensions 44, 45 of the steam tube 25 that project beyond the end plates 21, 22, the orifices 28 of the steam tube are open to all of the chambers 28-41, and 42. This will cause and allow steam to be ejected from the steam slots 23, 24 over the full length thereof, as desired for processing a fabric of maximum width. For processing narrower fabrics, the valve pistons are moved inward by appropriate rotation of the shaft 35. When moved to an intermediate position, such as shown in FIG. 9, all of the steam outlet orifices 28 communicating with the outermost chambers 41 are closed off and no steam can enter those chambers. Accordingly, steam is emitted from the slots 23, 24 only from the portions thereof overlying chambers 39-41 and 42. With progressive inward positioning adjustment of the valve pistons, the outer most chambers 39-41 can be progressively isolated from the steam supply, correspondingly reducing the overall length of the steam slots 23, 24 from which steam is emitted.

Since it is contemplated that the length of the center chamber 43 will correspond to the minimum fabric with to be processed, it is not necessary to subdivide the center chamber.

By moving the valve pistons 30, 31 in increments corresponding to the small chambers 38-41, these chambers are either fully open to or fully isolated from the steam supply. However, where desired, the valve pistons may be moved to an adjusted position closing some but less than all of the steam orifices within a chamber. In such cases, steam will be emitted from the partially closed chambers but at a reduced rate of flow.

In accordance with an aspect of the invention, when the effective width of the steam slots 23, 24 is reduced by inward adjustment of the valve pistons 30, 31, it is also desirable to reduce the overall rate of steam flow to the steam tube 25. The objective is to provide for a relatively constant rate of steam outflow per unit of effective length of the steam slots. This assures a uniform steaming action on both wide and narrow fabrics while optimizing the usage of steam. Where desired, the steam flow control may be integrated with the positioning of the valve pistons such that steam flow is automatically increased or decreased with adjustments of the positions of the valve pistons.

It can be readily appreciated that the steam box of the invention can be operated at a high degree of efficiency with respect to the usage of steam in connection with the processing of variable width fabrics. When fabrics of less than maximum width are being processed, the steam box is quickly and easily adjusted to cut off the flow of steam into outer sections of the steam box. By subdividing the steam box housing into small sections, it is practical, with the mechanisms of the invention, to progressively isolate the subdivided sections from the steam supply and thus assure optimum usage of the steam over the width of the fabric being processed.

It will be understood, of course, that the embodiment of the invention herein specifically disclosed is intended to be representative of the invention but not limiting as to the manner in which it may be carried out. Reference should be made to the following claims in determining the full scope of the invention.

What is claimed is:

1. A variable discharge steam box for use in the processing of fabric webs of variable width, which comprises an enclosed housing having an axis and an axial length sufficient to extend transversely across a full width of a fabric web of a predetermined maximum fabric width, a plurality of partition elements dividing said steam box axially into a central chamber and a plurality of additional chambers on opposite axial sides of said central chamber, said housing having a fabric-facing wall and said fabric-facing wall having steam outlet openings associated with each of said chambers for the discharge of steam onto a fabric web moving adjacent to said fabric-facing wall, a steam duct extending axially through said enclosed housing and having portions thereof within each of said chambers, said steam duct having at least one steam outlet orifice in each of said chambers, a steam inlet in a central portion of said steam duct to introduce steam under pressure into said central portion for flow axially outward within said steam duct toward opposite ends thereof, controllable valve elements in said steam duct operative to block axial steam flow in said steam duct at a pair of axially spaced apart positions therein to controllably limit the axial extent of the flow of steam within said steam duct axially outward from said central portion thereof, to establish an effective adjusted length of said steam duct and thereby determine an effective width of steam discharge from said steam box.

2. A steam box according to claim 1, wherein said controllable valve elements are operative, in at least one operative condition thereof, to limit the flow of steam to outlets of said steam duct positioned only within said central chamber, and in at least another operative condition thereof to limit the flow of steam to outlets of said steam duct positioned within said central chamber and within one or more of said additional chambers equally on opposite axial sides of said central chamber.

3. The method of using the steam box of claim 1 comprising the steps of supplying steam to said steam duct through said steam inlet, and controlling a rate of flow of steam to the steam duct as a function of the effective adjusted length of the steam duct, such that steam application to fabric webs of different width remains more constant.

4. A variable discharge steam box for use in the processing of fabric webs of variable width, which comprises an enclosed housing having an axis and an axial length sufficient to extend transversely across a full width of a fabric web of a predetermined maximum fabric width, a plurality of partition elements dividing said steam box axially into a central chamber and a plurality of additional chambers on opposite axial sides of said central chamber, said housing having a fabric-facing wall and said fabric-facing wall having steam outlet openings associated with each of said chambers for the discharge of steam onto a fabric web moving adjacent to said fabric-facing wall, a steam duct extending axially through said enclosed housing and having portions thereof within each of said chambers, said steam duct having at least one steam outlet orifice in each of said chambers, a steam inlet in a central portion of said steam duct to introduce steam under pressure into said central portion for flow axially outward within said steam duct toward opposite ends thereof, controllable valve elements in said steam duct operative to block said steam duct at multiple axial positions therein to controllably limit the flow of steam within said steam duct axially outward from said central portion thereof, to controllably limit the effective width of steam discharge from said steam box, said controllable valve elements comprising axially movable valve pistons positioned within said steam duct and controllably axially movable therein to increase or decrease the length of said steam duct receiving steam from said steam inlet.

5. A steam box according to claim 4, wherein a threaded shaft extends axially through said steam duct and threadedly engages said valve pistons for opposed axial movements toward and away from said central chamber, and said threaded shaft is accessible from at least one end of said steam duct for rotational operation.

6. A steam box according to claim 5, wherein a guide element extends through said steam duct in parallel relation to said threaded shaft and slidably engages said valve pistons.

7. A steam box according to claim 4, wherein said steam duct is formed with a plurality of axially spaced outlet orifices in each of said chambers, and said valve pistons are controllably movable to positions closing one or more outer outlet orifices in an additional chamber to reduce steam flow in outmost additional chambers receiving steam from said steam duct.

8. A steam box according to claim 4, wherein said steam duct is provided with a plurality of axially spaced outlet orifices in each of said chambers.

9. A steam box according to claim 4, wherein said fabric-facing wall of said housing is provided with one or more slots extending axially therein along an extent corresponding to said predetermined maximum fabric width.

* * * * *